US011499204B2

(12) United States Patent
Mizoguchi et al.

(10) Patent No.: US 11,499,204 B2
(45) Date of Patent: Nov. 15, 2022

(54) MARTENSITIC STAINLESS STEEL SHEET, METHOD FOR MANUFACTURING SAME, AND SPRING MEMBER

(71) Applicant: NIPPON STEEL STAINLESS STEEL CORPORATION, Tokyo (JP)

(72) Inventors: Taichiro Mizoguchi, Tokyo (JP); Hiroyasu Matsubayashi, Tokyo (JP); Katsuyuki Shiotsuki, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 109 days.

(21) Appl. No.: 16/965,369

(22) PCT Filed: Jan. 21, 2019

(86) PCT No.: PCT/JP2019/001579
§ 371 (c)(1),
(2) Date: Jul. 28, 2020

(87) PCT Pub. No.: WO2019/176283
PCT Pub. Date: Sep. 19, 2019

(65) Prior Publication Data

US 2021/0155998 A1 May 27, 2021

(30) Foreign Application Priority Data

Mar. 15, 2018 (JP) ..... JP2018-047508

(51) Int. Cl.
*C21D 9/46* (2006.01)
*C22C 38/54* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2002/0164260 A1* 11/2002 Koga ..... C22C 38/18 148/326

FOREIGN PATENT DOCUMENTS

CN 103534377 A * 1/2014 ..... C21D 6/002
CN 104532129 4/2015
(Continued)

OTHER PUBLICATIONS

Machine translation of CN103534377A. (Year: 2014).*

*Primary Examiner* — Xiaowei Su
(74) *Attorney, Agent, or Firm* — Clark & Brody LP

(57) ABSTRACT

A martensitic stainless steel sheet has a composition containing, (mass %), from 0.10 to 0.15% of C, from 0.05 to 0.80% of Si, from 0.05 to 2.00% of Mn, 0.040% or less of P, 0.003% or less of S, from 0.05 to 0.50% of Ni, from 11.0 to 15.0% of Cr, from 0.02 to 0.50% of Cu, from 0.005 to 0.06% of N, from 0.001 to 0.20% of Al, from 0 to 1.00% of Mo, from 0 to 0.50% of V, from 0 to 0.01% of B, balance Fe and unavoidable impurities. An M value=420C−11.5Si+7Mn+23Ni−11.5Cr−12Mo−10V+9Cu−52Al+470N+189 is 100 or more. A carbonitride number density having a circle equivalent diameter of 1.0 μm or more is 15.0 or less per 0.01 $mm^2$. 0.2% yield strength is 1,100 $N/mm^2$ or more.

4 Claims, 2 Drawing Sheets

(51) Int. Cl.

| | |
|---|---|
| ***C22C 38/46*** | (2006.01) |
| ***C22C 38/44*** | (2006.01) |
| ***C22C 38/42*** | (2006.01) |
| ***C22C 38/18*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/54* (2013.01); *C21D 2211/008* (2013.01)

(56) References Cited

FOREIGN PATENT DOCUMENTS

| | | |
|---|---|---|
| JP | 63-293142 | 11/1988 |
| JP | 05-171282 | 7/1993 |
| JP | 09-263894 | 10/1997 |
| JP | 2000-129400 | 5/2000 |
| JP | 2000-234150 | 8/2000 |
| JP | 2000-256802 | 9/2000 |
| JP | 2002-194506 | 7/2002 |
| JP | 2003-089851 | 3/2003 |
| JP | 2004-099990 | 4/2004 |
| JP | 2004-244691 | 9/2004 |
| JP | 2007-113068 | 5/2007 |
| JP | 2015-086405 | 5/2015 |
| JP | 2016-006222 | 1/2016 |
| JP | 2016-060936 | 4/2016 |
| WO | 2012/157680 | 11/2012 |

* cited by examiner

[Fig.1]
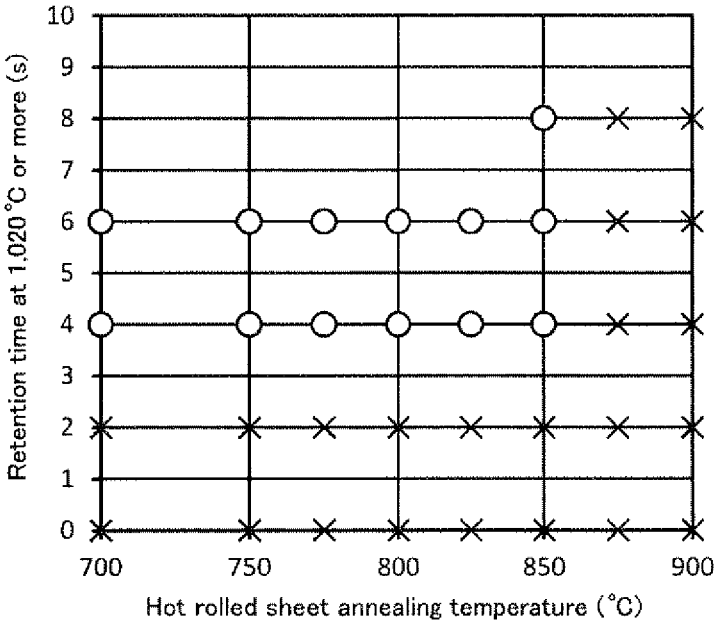
[Fig.2]
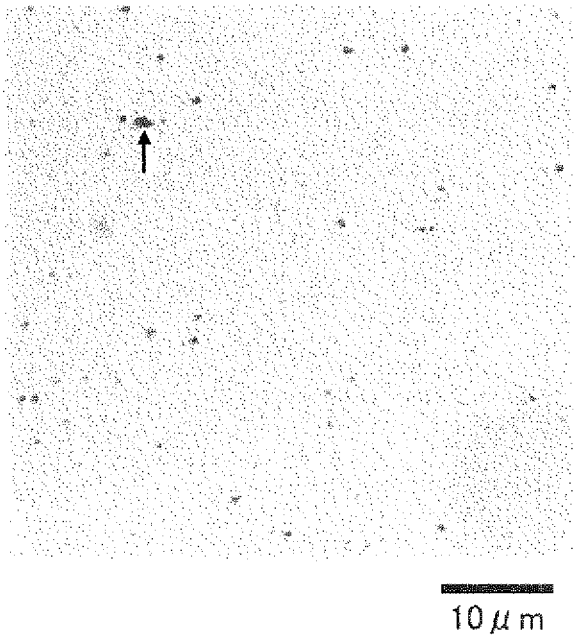

[Fig.3]
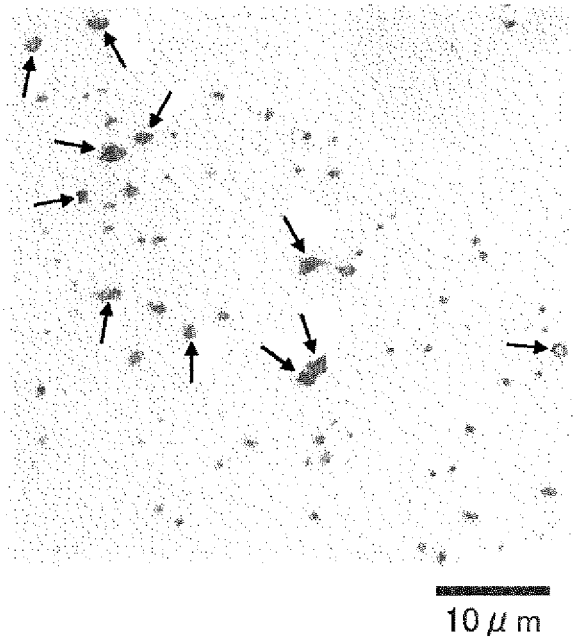

MARTENSITIC STAINLESS STEEL SHEET, METHOD FOR MANUFACTURING SAME, AND SPRING MEMBER

TECHNICAL FIELD

The present invention relates to a high strength martensitic stainless steel sheet that is suitable for a spring member produced by applying shearing work or bending work to a steel sheet material, such as a retractor spiral spring for an automobile seat belt, a spring for an electronic device component, a gasket, and a metal packing, and a method for producing the same. The invention also relates to a spring member produced by using the martensitic stainless steel sheet.

BACKGROUND ART

The known stainless steel species suitable for a spring material include a metastable austenitic stainless steel. For example, PTL 1 describes the application of a metastable austenitic stainless steel having a high Young's modulus after an aging treatment to a spiral spring for a seat belt retractor. PTL 2 describes a metastable austenitic stainless steel capable of retaining the excellent strength even exposed to a corrosive environment. PTL 3 describes a metastable austenitic stainless steel formed of a recrystallized structure, a non-recrystallized structure, and fine deposits, capable of omitting a temper rolling treatment and an aging treatment.

The metastable austenitic stainless steel is expensive due to the large Ni content thereof. A martensitic stainless steel may be considered as useful as a less expensive stainless steel species capable of being applied to the purpose of a spring material. However, the martensitic stainless steel generally has a defect of inferior "bendability".

PTL 4 describes a ferrite-martensite dual phase structure stainless steel. This technique is to enhance the workability to a spring shape by mixing a ferrite phase having larger ductility than a martensite phase. However, due to the soft ferrite phase, the strength thereof may not be sufficiently satisfactory in some cases for the purpose of a spring material, such as a retractor spiral spring and a spring for an electronic device component, to which the metastable austenitic stainless steel has been applied.

PTLs 5 to 8 each describe a martensite-austenite dual phase structure stainless steel. These steels can provide good bendability by mixing an austenite phase having further larger ductility than a ferrite phase. However, the technique of PTL 5 uses Cr nitride, which tends to cause decrease of the corrosion resistance. The techniques of PTLs 6 to 8 can save expensive Ni from the standpoint of the alloying elements, but require a heat treatment for distributing C in the austenite phase, which increases the production cost, and therefore there is a demand of further improvement for the achievement of an inexpensive stainless steel sheet for a spring.

PTL 9 describes a technique that secures good bendability by restricting the form of inclusions in a martensitic stainless steel. According to the technique, a martensitic stainless steel sheet that has a high strength and is excellent in bendability and corrosion resistance can be provided.

CITATION LIST

Patent Literatures

PTL 1: JP-A-9-263894
PTL 2: JP-A-2007-113068

PTL 3: JP-A-2002-194506
PTL 4: JP-A-2004-99990
PTL 5: JP-A-5-171282
PTL 6: JP-A-2016-60936
PTL 7: JP-A-2000-129400
PTL 8: JP-A-2015-86405
PTL 9: JP-A-2016-6222

SUMMARY OF INVENTION

Technical Problem

According to the technique of PTL 9, a martensitic stainless steel has been expected to spread not only to the purpose of a metal gasket used around an automobile engine but also to the purpose of various springs including a retractor spiral spring. However, in consideration of the use in various corrosive environments, it has been found that it is also important to enhance the resistance against delayed fracture in the martensitic stainless steels. The present inventors have produced a high strength steel sheet having a martensite structure with the steels described in PTL 9, and have investigated the delayed fracture resistance under severe conditions of test pieces bent into U-shape. As a result, it has been confirmed that cracks are formed within a shorter period of time than an austenitic stainless steel species having an equivalent strength level. It is considered that the delayed fracture of this type is caused by stress corrosion cracks.

An object of the invention is to provide a martensitic stainless steel sheet that has good bendability, a high strength, and excellent delayed fracture resistance.

Solution to Problem

In the production process of a steel sheet of a martensitic stainless steel, in general, a hot rolled steel sheet is annealed at the $Ac_1$ point or lower for a long period of time, so as to perform a treatment of decomposing the martensite phase formed in the hot rolling process to a ferrite phase and a carbonitride. This heat treatment is referred to as "hot rolled sheet annealing" in the description herein. The removal of the hard martensite phase as much as possible through the hot rolled sheet annealing to soften the steel sheet is important for the production of a thin sheet material in the subsequent cold rolling process. The steel sheet controlled to have the target thickness in the cold rolling is subjected to a heat treatment of heating to a high temperature where the austenite phase is stable, and then quenching, thereby regulated to a martensite structure having high strength. This final heat treatment is referred to as "finish annealing" in the description herein.

In the finish annealing, while the dissolving reaction of the carbonitride formed in the hot rolled sheet annealing proceeds, the heating and retention of the thin sheet material at a high temperature for a prolonged period of time until the carbonitride disappears through dissolution involve difficulty in commercial production, and also there is generally not necessity of such a structure state. Therefore, the matrix (metal base) of the martensitic stainless steel sheet generally has dispersed therein the carbonitride that has not completely dissolved but has remained. The carbonitride that has not completely dissolved but has remained is referred to as an "undissolved carbonitride" in the description herein. The "carbonitride" herein means particles formed of a compound phase having a metal element bonded to one or both of carbon and nitrogen. Carbide particles containing substantially no nitrogen and nitride particles containing substantially no carbon are also encompassed in the "carbonitride" referred in the description herein. It is considered that carbon that constitutes the carbonitride is bonded to the metal element mainly in the form of $M_{23}C_6$ (wherein M represents the metal element constituting the matrix, such as Cr and Fe). The fact that the granular phase dispersed in the matrix is the carbonitride can be confirmed by such an analysis method as EPMA (electron probe micro analyzer) and EDX (energy dispersive X-ray spectroscopy).

As a result of the detailed investigations, the present inventors have found that the delayed fracture causing a problem in the martensitic stainless steel sheet can be significantly suppressed by strictly restricting the existing amount of the carbonitride having a large size. The carbonitride having a large size existing in the martensite structure after the finish annealing is the aforementioned undissolved carbonitride. It is considered that the carbonitride of this kind functions as a trap site for hydrogen, and becomes a supply source of hydrogen in the environment where stress corrosion cracks occur. It is estimated that hydrogen provokes stress corrosion cracks, which become a factor of the delayed fracture. It is considered that some of the precipitated particles may have a strong function constraining the trapped hydrogen in the vicinity of the particle, and thus are useful for suppressing the diffusion of hydrogen in the steel. However, the carbonitride having a large size has a weak trapping force for hydrogen, and does not exhibits the useful function. The invention has been completed based on the knowledge.

The object can be achieved by a martensitic stainless steel sheet having: a chemical composition containing, in terms of percentage by mass, from 0.10 to 0.15% of C, from 0.05 to 0.80% of Si, from 0.05 to 2.00% of Mn, 0.040% or less of P, 0.003% or less of S, from 0.05 to 0.50% of Ni, from 11.0 to 15.0% of Cr, from 0.02 to 0.50% of Cu, from 0.005 to 0.06% of N, from 0.001 to 0.20% of Al, from 0 to 1.00% of Mo, from 0 to 0.50% of V, from 0 to 0.01% of B, the balance of Fe and unavoidable impurities, and having an M value defined by the following expression (1) of 100 or more; a metal structure including a martensite phase as a matrix, and having a number density of a carbonitride having a circle equivalent diameter of 1.0 μm or more of 15.0 or less per 0.01 $mm^2$ on a cross section in parallel to a rolling direction and a thickness direction (L cross section); and a 0.2% yield strength in a rolling direction of 1,100 $N/mm^2$ or more:

$$M \text{ value} = 420C - 11.5Si + 7Mn + 23Ni - 11.5Cr - 12Mo - 10V + 9Cu - 52Al + 470N + 189 \quad (1)$$

wherein in the expression (1), the element symbol is substituted by the content of the element in terms of percentage by mass, and is substituted by 0 for an element that is not contained.

The martensitic stainless steel sheet can be obtained by a production method including a steel sheet production process including hot rolling, hot rolled sheet annealing, cold rolling, and finish annealing, in this order, the hot rolled sheet annealing step including retaining at a temperature range of from 750 to 850° C. for 6 hours or more to decompose a martensite phase to a ferrite phase and a carbonitride, the finish annealing step including retaining to a temperature range of from 1,020 to 1,100° C. for 4 seconds or more. The cold rolling step may include plural cold rolling steps with intermediate annealing intervening therebetween.

The invention also provides a spring member including the martensitic stainless steel sheet.

Advantageous Effects of Invention

According to the invention, a high strength martensitic stainless steel sheet having good bendability that is significantly improved in the delayed fracture resistance can be provided. The steel sheet is suitable for a retractor spiral spring for an automobile seat belt, a spring for an electronic device component, a gasket, a metal packing, and the like, and can provide higher reliability than the ordinary martensitic stainless steels under various use environments. Furthermore, the steel sheet is expected as a substitute for an austenitic steels having been frequently used for these applications, and thus is advantageous in cost.

BRIEF DESCRIPTION OF DRAWINGS

FIG. 1 is a graph showing the influence of the hot rolled sheet annealing temperature and the retention time at 1,020° C. or more in the finish annealing on the quality of the characteristics of the steel sheet.

FIG. 2 is the SEM image of the L cross section of No. A1-1 as an example of the invention.

FIG. 3 is the SEM image of the L cross section of No. A1-4 as a comparative example.

DESCRIPTION OF EMBODIMENTS

[Chemical Composition]

In the following description, "%" relating to the steel composition means "% by mass" unless otherwise indicated.

C is an austenite forming element, and is effective for the strengthening of the martensite phase. With a too small C content, the strengthening effect is not sufficiently exhibited. Furthermore, it is difficult to control the composition for achieving an austenite phase structure at the heating temperature in the finish annealing (i.e., to control the M value described later). The C content is necessarily 0.10% or more. However, with a too large C content, the amount of the undissolved carbonitride is increased, and it is difficult to control the existing amount of the carbonitride having a large size within the prescribed range described later. Furthermore, a Cr carbide is newly deposited at the grain boundary in the cooling process of the finish annealing, which becomes a factor lowering the corrosion resistance. As a result of the various investigations, the C content is restricted to 0.15% or less.

Si is effective as a deoxidizing agent, and is effective for hardening the martensite phase to enhance the strength of the steel material. For promoting these effects, the Si content is desirably 0.05% or more, and may be managed to be 0.20% or more. However, an excessive addition of Si becomes a factor lowering the workability and the toughness. Furthermore, it is difficult to control the composition providing an M value of the prescribed value or more. The Si content is restricted to 0.80% or less, and may be 0.60% or less.

Mn is an austenite forming element, and a Mn content of 0.05% or more is desirably secured for controlling the M value to the prescribed value or more, and may be managed to 0.10% or more. However, with a too large Mn content, the stability of the austenite phase is increased to make a residual austenite phase existing after the finish annealing, which may decrease the strength in some cases. The Mn content is restricted to 2.00% or less, and may be managed to a range of 1.00% or less.

P is an element that decreases the toughness, S is an element that decreases the corrosion resistance through the formation of MnS and the like, and therefore the contents of these elements are desirably low. As a result of the investigations, P is allowed to be contained in a range of 0.040% or less, and S is allowed to be contained in a range of 0.003% or less. However, the excessive reduction of the P content and the S content increases the load in the steel making, and therefore the P content is generally controlled to 0.001% or more, and the S content is generally controlled to 0.0003% or more.

Ni is an austenite forming element, and Ni content of 0.05% or more is desirably secured for controlling the M value to the prescribed value or more, and may be managed to 0.10% or more. However, with a too large Ni content, the stability of the austenite phase is increased to make a residual austenite phase existing after the finish annealing, which may decrease the strength in some cases. Furthermore, the increase of the production cost occurs. The Ni content is restricted to 0.50% or less.

Cr is an element that is necessary for imparting corrosion resistance as a stainless steel. However, as Cr is a ferrite forming element, the increase of the Cr content causes the necessity of increase of the content of the austenite forming elements, such as C, N, Ni, and Mn in order to provide a martensite structure, which increases of the cost of the steel material. Furthermore, a large amount of Cr contained becomes a factor decreasing the toughness. The invention targets a steel having a Cr content of from 11.0 to 15.0%, which may be managed to a range of from 11.5 to 13.5%.

Cu is an austenite forming element and is effective for controlling the M value to the prescribed value or more. Furthermore, an effect of enhancing the corrosion resistance is achieved within a range of a small amount thereof added. The Cu content is desirably secured to 0.02% or more. A large amount Cu added may rather be a factor decreasing the corrosion resistance. The Cu content is 0.50% or less.

N is an austenite forming element, and is effective for the strengthening of the martensite phase, as similar to C. As compared to C, N advantageously readily remains in a dissolved state in the matrix even though the cooling rate in the finish annealing becomes relatively low, but the strengthening effect thereof is smaller than C. As a result of the various investigations, the N content is from 0.005 to 0.06%.

Al is an element that has a strong deoxidizing effect, but as described in PTL 9, the deoxidation mainly by Si deoxidation is advantageous over the deoxidation with Al alone from the standpoint that the oxide inclusions is softened to reduce the anisotropy in the workability and the fatigue resistance characteristics. Herein, the steel is refined to make a total Al amount in the steel of 0.001% or more. An increased Al content may adversely affect the toughness in some cases. Furthermore, Al is a ferrite forming element, and therefore a large amount thereof contained makes difficult to control the composition for providing the martensite structure. The Al content is restricted to 0.20% or less, and may be managed to 0.10% or less, or to 0.05% or less.

Mo is an element that is effective for enhancing the corrosion resistance, and therefore may be added depending on necessity. For sufficiently providing the effect thereof, a Mo content of 0.10% or more is more effectively secured. However, a large amount of Mo contained becomes a factor increasing the production cost. Furthermore, Mo is a ferrite forming element, and therefore a large amount thereof contained makes difficult to control the composition for providing the martensite structure. In the case where Mo is added, the addition thereof is desirably within a content range of 1.00% or less.

V and B are elements that are effective for improving the productivity, the strength, the fatigue resistance characteristics, and the like. One or more kinds of these elements may be added depending on necessity. The content ranges are 0.50% or less for V, 0.50% or less for Nb, and 0.010% or less for B. The more effective ranges are from 0.01 to 0.50% for V and from 0.0005 to 0.01% for B.

The contents of the elements are controlled to make an M value defined by the following expression (1) of 100 or more.

$$M\text{ value}=420C-11.5Si+7Mn+23Ni-11.5Cr-12Mo-10V+9Cu-52Al+470N+189 \quad (1)$$

In the expression (1), the element symbol is substituted by the content of the element in terms of percentage by mass, and is substituted by 0 for an element that is not contained.

The M value is an index showing the amount (% by volume) of the martensite phase formed in cooling to ordinary temperature after heating in the finish annealing. With the chemical composition having an M value of 100 or more, the matrix becomes a structure occupied by 100% of an austenite phase at the finish annealing temperature, and thus a martensite structure (i.e., a structure state where the matrix is formed of a martensite phase) can be obtained through the cooling process of the finish annealing.

[Number Density of Carbonitride]

As described above, it has been found that the decrease of the existing amount of the carbonitride having a large size distributed in the martensite structure is significantly effective as a measure for improving the delayed fracture resistance of a member formed of a high strength martensitic stainless steel sheet. As a result of the detailed investigations, the metal structure is controlled to have a number density of a carbonitride having a circle equivalent diameter of 1.0 μm or more of 15.0 or less per 0.01 $mm^2$ on the cross section in parallel to the rolling direction and the thickness direction (L cross section). It is considered that the carbonitride having a circle equivalent diameter of 1.0 μm or more becomes a site trapping hydrogen in the steel, but also functions as a supply source of hydrogen in the environment where stress corrosion cracks occur due to the weak constraining capability for hydrogen. The carbonitride of this kind is the "undissolved carbonitride" having a large size remaining undissolved in the matrix in the heating and retention in the finish annealing. It has been found that in the case where the metal structure has a number density of the carbonitride having a circle equivalent diameter of 1.0 μm or more of 15.0 or less per 0.01 $mm^2$, the effect of improving the bendability of the high strength martensitic stainless steel can be simultaneously obtained.

For controlling the number of the carbonitride having a large size to the aforementioned range, it is important that (i) the chemical composition is controlled to the aforementioned range, (ii) the heating and retaining temperature in the hot rolled sheet annealing is prevented from becoming too high, so that the carbonitride formed through the decomposition of the martensite phase to the ferrite phase and the carbonitride is prevented from becoming coarse, and (iii) the finish annealing temperature is controlled to 1,020° C. or more to facilitate the dissolution of the carbonitride. Accordingly, the desired structure state can be stably obtained by combining all the conditions (i) to (iii).

[0.2% Yield Strength]

In consideration of the application to the purpose of a spring member, such as a retractor spiral spring and a spring for an electronic device component, the invention targets a martensitic stainless steel sheet having a strength level with a 0.2% yield strength in the rolling direction of 1,100 N/mm$^2$ or more, and more preferably 1,150 N/mm$^2$ or more. For providing the strength level, it is important that the chemical composition is controlled to the aforementioned range, and the finish annealing temperature is controlled to 1,020° C. or more. The tensile strength in the rolling direction is preferably 1,350 N/mm$^2$ or more, and the breaking elongation therein is preferably 6.0% or more.

[Production Method]

The martensitic stainless steel sheet according to the invention can be obtained by using an ordinary stainless steel sheet production process including hot rolling, hot rolled sheet annealing, cold rolling, [intermediate annealing, cold rolling], and finish annealing, in this order. The steps in the brackets each are an arbitrary step, which means that the step may be performed once or more. The steps are described below.

(Hot Rolling)

A cast piece such as a continuously cast slab is heated to from 1,100 to 1,300° C., and then subjected to hot rolling by an ordinary method to provide a hot rolled steel sheet. The thickness of the hot rolled steel sheet may be, for example, from 3.0 to 6.0 mm, and the coiling temperature may be, for example, from 650 to 800° C.

(Hot Rolled Sheet Annealing)

The hot rolled steel sheet after completing the hot rolling, i.e., the so-called as hot steel sheet, has a hard structure formed of a martensite phase, a ferrite phase, the carbonitride, and the like, and is difficult to proceed directly to the cold rolling step. The hot rolled sheet annealing is a heat treatment for softening the hard martensite phase by decomposing to the ferrite phase and the carbonitride by using a batch type heat treatment furnace. The heating and retaining temperature is necessarily the $Ac_1$ point or lower, and is restricted to a temperature of 850° C. or less in the invention. With a higher temperature than that, the carbonitride formed through the decomposition reaction of the martensite phase becomes coarse to fail to dissolve sufficiently in the finish annealing described later. As a result, the structure state contains a large amount of the undissolved carbonitride having a large size. With a too low heating and retaining temperature, on the other hand, the softening becomes insufficient. As a result of the investigations, it is necessary to heat to 750° C. or more. By heating and retaining at from 750 to 850° C. for 6 hours or more, the martensite phase is decomposed to the ferrite phase and the carbonitride to achieve the softening. The heating and retaining temperature and time may be controlled within the aforementioned ranges depending on the structure state of the hot rolled steel sheet. The excessive prolongation of the heating and retaining time deteriorates the productivity. In general, the heating and retaining time at from 750 to 850° C. is desirably set in a range of 30 hours or less. After the heating and retaining, the steel sheet may be air cooled.

(Cold Rolling and Intermediate Annealing)

The steel sheet having been softened by subjecting to the hot rolled sheet annealing is pickled and then cold rolled. The cold rolling step is performed once or multiple times depending on the final target thickness. In the case where the cold rolling step is performed multiple times, intermediate annealing is performed between the cold rolling steps. The intermediate annealing may be performed under conditions of from 750 to 850° C. for a soaking time of from 0 second to 2 minutes. The soaking time of 0 second herein means a heating pattern where the cooling is started immediately after the material temperature reaches the prescribed temperature. The cold rolling reduction ratio (which is the rolling reduction ratio of each of the cold rolling steps in the case where the cold rolling is performed multiple times) is preferably set to a range of from 30 to 70%. The rolling reduction ratio R (%) is defined by the following expression (2).

$$R=(h_0-h_1)/h_0\times 100 \quad (2)$$

In the expression, $h_0$ represents the initial thickness (mm) before rolling, and $h_1$ represents the thickness (mm) after the final pass of rolling.

The final thickness after the cold rolling may be, for example, from 0.15 to 2.0 mm.

(Finish Annealing)

The finish annealing is a heat treatment of heating to an austenite single phase temperature range for finally providing a steel sheet having a martensite structure. This heat treatment is also important for enhancing the strength of the martensitic stainless steel since the heat treatment can promote the dissolution of the carbonitride. The steel that satisfies the aforementioned composition and is controlled for the composition to have an M value of 100 or more has a temperature range providing an austenite single phase at $Ac_1$ point or more. A martensite structure can be obtained by heating to the austenite single phase temperature range and then cooling to around ordinary temperature. Furthermore, the prolongation of the heating and retaining time promotes the dissolution of the carbonitride, and therefore by heating to the austenite single phase temperature range, a strength level, for example, with a 0.2% yield strength in the rolling direction of 1,100 N/mm$^2$ or more can be sufficiently obtained. However, according to the investigations by the inventors, it has been found that for controlling the existing amount of the undissolved carbonitride having a large size to the small value as described above, the heating, for example, to 1,000° C. for a soaking time of approximately 60 seconds is insufficient, but heating to a further higher temperature range is necessary.

Specifically, it is necessary to retain at from 1,020 to 1,100° C. for 4 seconds or more. More specifically, the maximum finally achieving material temperature is from 1,020 to 1,100° C., and the period of time where the material temperature is retained to 1,020° C. or more (which may be hereinafter referred to as a "retention time at 1,020° C. or more") is 4 seconds or more. The material temperature means the temperature of the center portion in the thickness direction. The temperature of the center portion in the thickness direction can be found from the furnace temperature, the thickness, the retention time of the steel sheet in the furnace, and the measured temperature of the surface of the steel sheet. A continuous annealing furnace can be used for the practical operation. At this time, the maximum finally achieving material temperature and the retention time at 1,020° C. or more can be controlled based on the heating conditions of the zones in the furnace, the thickness, and the heating pattern (i.e., the time-material temperature curve) derived from the data of the line speed. In the case where the maximum finally achieving material temperature is excessively high, or the retention time at 1,020° C. or more is excessively long, the oxidized scale is thickened to make the subsequent descaling difficult. Accordingly, the maximum finally achieving material temperature is 1,100° C. or less. The retention time at 1,020° C. or more is desirably from 4 to 30 seconds, and more desirably from 5 to 20 seconds. The cooling after the heating and retaining may be either method of water cooling or air cooling, and the average cooling rate from 500° C. to 100° C. is desirably 2° C./sec or more, and more desirably 10° C./sec or more.

FIG. 1 shows a graph obtained by plotting the quality of the characteristics for the specimens produced with a steel Al in Table 1 described later by performing various combinations of the hot rolled sheet annealing temperature (for a retention time of 24 hours) and the retention time at 1,020° C. or more in the finish annealing. The plot shown by a white circle shows the specimen having a 0.2% yield strength in the rolling direction of 1,100 N/mm$^2$ or more and a fracture time in the delayed fracture test of 72 hours or more (strength-delayed fracture resistance balance: good), and the plot shown by a cross mark shows the specimen having a 0.2% yield strength in the rolling direction of less than 1,100 N/mm$^2$ or a fracture time in the delayed fracture test of less than 72 hours (strength-delayed fracture resistance balance: poor). The test method is described later. It is understood that a martensitic stainless steel sheet excellent in the strength-delayed fracture resistance balance can be obtained in the case where both the hot rolled sheet annealing and the finish annealing are performed under the conditions defined in the invention.

EXAMPLES

The steels shown in Table 1 were melted to provide cast pieces. The cast piece was heated to from 1,150 to 1,250° C. for 60 minutes and then subjected to hot rolling to provide a hot rolled steel sheet having a thickness of 4.5 mm at a coiling temperature of from 680 to 800° C. The coil of the hot rolled steel sheet was placed in a bell-type annealing furnace and subjected to hot rolled sheet annealing under the condition shown in Table 2. After the heating and retaining, the steel sheet was air cooled in the furnace. The steel sheet after completing the hot rolled sheet annealing was pickled, and then subjected to cold rolling 2 times or 3 times under the condition shown in Table 2. Between the cold rolling steps, intermediate annealing at the temperature shown in Table 2 for a soaking time of 0 second and pickling were performed. The first, second, and third cold rolling shown in Table 2 mean the cold rolling of the first time, the second time, and the third time, respectively. The intermediate annealing of the first time performed before the second cold rolling is shown as "first intermediate annealing", and the intermediate annealing of the second time performed before the third cold rolling is shown as "second intermediate annealing". The cold rolled steel sheet obtained after completing the final cold rolling step was subjected to the finish annealing with a continuous annealing furnace under the condition shown in Table 2. After heating in the finish annealing, the steel sheet was cooled to a temperature around ordinary temperature at an average cooling rate from 500° C. to 100° C. in a range of from 20 to 30° C. The steel sheet was pickled after the finish annealing. A specimen of the resulting steel sheet was subjected to the following investigations.

[Number Density of Undissolved Carbonitride Having Large Size]

The cross section in parallel to the rolling direction and the thickness direction (L cross section) was subjected to oxalic acid electrolytic etching to produce an observation surface, which was observed with an SEM (scanning electron microscope). Plural view fields that did not overlap each other were randomly selected, and areas of 0.2 mm$^2$ in total were observed. The areas of the carbonitride particles observed in the view fields were measured with an image processing software, the number of the carbonitride having a circle equivalent diameter of 1.0 μm or more was counted, and the total number was calculated and converted to the number density per 0.01 mm$^2$. In the observation in each of the view fields, for the particles having a part protruding outside the view field, a particle that had a circle equivalent diameter of 1.0 μm or more calculated from the area existing within the view field was counted.

FIG. 2 shows the SEM image of the L cross section of No. A1-1 as an example of the invention. FIG. 3 shows the SEM image of the L cross section of No. A1-4 as a comparative example. The particles shown with the arrows in the images correspond to the carbonitride having a circle equivalent diameter of 1.0 μm or more. While both the specimens are derived from the hot rolled steel sheets having the same chemical composition, it is understood that the specimen shown in FIG. 2 as an example of the invention has a significantly smaller existing amount of the carbonitride having a large size than the specimen shown in FIG. 3 as a comparative example.

[Tensile Characteristics]

The tensile test in the rolling direction was performed with a JIS No. 13B test piece according to JIS Z2241:2011, and the 0.2% yield strength (N/mm$^2$), the tensile strength (N/mm$^2$), and the breaking elongation (%) were obtained by the offset method.

[Hardness]

The surface of the steel sheet was measured for the Vickers hardness HV1 according to JIS Z2244:2009.

[Delayed Fracture Resistance]

According to the method B of JIS G0576:2001, a U-shape bent test piece was produced with a test specimen having a dimension of 15 mm in width and 80 mm in length with the longitudinal direction directed to the rolling direction, and subjected to a stress corrosion crack test by simple immersion in a 30% calcium chloride solution (pH 3.5±0.1) at 80±1° C. The presence of fracture was examined every 1 hour from the start of immersion to 8 hours, and thereafter every 24 hours. The elapsed time from the start of test to the first recognition of fracture was designated as the fracture time (h) of the specimen. For example, a specimen having a fracture time of 96 hours is evaluated to have such a capability that the specimen is not fractured until an elapsed time of at least 72 hours. The number of test n was 3, and the fracture time of the specimen that had the shortest fracture time was used as the fracture time of the material. Herein, a specimen having a fracture time of 72 hours or more was evaluated as pass (delayed fracture resistance: good), based on the fracture time of the metastable austenitic stainless steel SUS301-CSP/H material frequently used as a spring material.

[Bendability]

According to the V-block method of JIS Z2248:2006, onto a test piece having a dimension of 25 mm in width and 50 mm in length collected in such a manner that the bending ridge line was in parallel to the rolling direction, a V-block having a tip radius of from 0.2 to 1.0 mm and an angle of 90° was pressed with a force of 10 kN, and the bendability was evaluated. The test was performed 3 times for each of the tip radii, the presence of cracks on the bending ridge line was visually evaluated, and the minimum radius where no crack was observed in all the three tests was designated as the critical bending radius.

The results above are shown in Table 3. In the column of total evaluation, a specimen that has a strength level with a 0.2% yield strength in the rolling direction of 1,100 N/mm$^2$ or more and a delayed fracture resistance with a fracture time of 72 hours or more is shown by A (strength-delayed fracture resistance balance: good), and the others are shown by B (strength-delayed fracture resistance balance: poor).

TABLE 1

| Class | Steel No. | C | Si | Mn | P | S | Ni | Cr | Cu | N | Al | Mo | V | B | M value |
|---|---|---|---|---|---|---|---|---|---|---|---|---|---|---|---|
| | | Chemical composition (% by mass) | | | | | | | | | | | | | |
| Steel of invention | A1 | 0.124 | 0.49 | 0.35 | 0.028 | 0.0016 | 0.20 | 12.40 | 0.20 | 0.019 | 0.009 | — | — | — | 110.2 |
| | A2 | 0.109 | 0.51 | 0.30 | 0.028 | 0.0013 | 0.18 | 13.38 | 0.43 | 0.043 | 0.018 | — | — | — | 104.4 |
| | A3 | 0.127 | 0.43 | 1.78 | 0.033 | 0.0010 | 0.38 | 13.93 | 0.13 | 0.024 | 0.025 | 0.53 | — | — | 103.2 |
| | A4 | 0.133 | 0.53 | 0.86 | 0.024 | 0.0009 | 0.19 | 11.77 | 0.08 | 0.013 | 0.043 | — | 0.21 | — | 116.3 |
| | A5 | 0.141 | 0.22 | 0.60 | 0.030 | 0.0022 | 0.11 | 14.65 | 0.21 | 0.050 | 0.032 | — | — | 0.0023 | 107.7 |
| Comparative steel | B1 | 0.186 | 0.35 | 0.25 | 0.029 | 0.0012 | 0.15 | 12.63 | 0.09 | 0.014 | 0.025 | — | — | — | 129.1 |
| | B2 | 0.133 | 0.62 | 0.24 | 0.027 | 0.0021 | 0.13 | 14.30 | 0.22 | 0.013 | 0.016 | — | — | — | 85.2 |

Underline: outside the scope of invention

TABLE 2

| Class | Example No. | Steel No. | Hot rolled sheet annealing Temperature (° C.) | Hot rolled sheet annealing Time (h) | First cold rolling Initial thickness (mm) | First cold rolling Final thickness (mm) | First intermediate annealing Temperature (° C.) | Second cold rolling Initial thickness (mm) |
|---|---|---|---|---|---|---|---|---|
| Example | A1-1 | A1 | 800 | 24 | 4.5 | 2.0 | 800 | 2.0 |
| Example | A1-2 | A1 | 780 | 24 | 4.5 | 2.0 | 800 | 2.0 |
| Example | A1-3 | A1 | 840 | 9 | 3.0 | 1.5 | 820 | 1.5 |
| Comparative Example | A1-4 | A1 | 800 | 24 | 4.5 | 2.0 | 800 | 2.0 |
| Comparative Example | A1-5 | A1 | 880 | 9 | 4.5 | 2.0 | 800 | 2.0 |
| Example | A2-1 | A2 | 800 | 24 | 4.5 | 2.0 | 800 | 2.0 |
| Example | A2-2 | A2 | 780 | 24 | 4.5 | 2.0 | 800 | 2.0 |
| Example | A2-3 | A2 | 840 | 9 | 3.0 | 1.5 | 820 | 1.5 |
| Comparative Example | A2-4 | A2 | 800 | 24 | 4.5 | 2.0 | 800 | 2.0 |
| Comparative Example | A2-5 | A2 | 880 | 9 | 4.5 | 2.0 | 800 | 2.0 |
| Example | A3-1 | A3 | 800 | 24 | 4.5 | 2.0 | 800 | 2.0 |
| Example | A3-2 | A3 | 780 | 24 | 4.5 | 2.0 | 800 | 2.0 |
| Example | A3-3 | A3 | 840 | 9 | 3.0 | 1.5 | 820 | 1.5 |
| Comparative Example | A3-4 | A3 | 800 | 24 | 4.5 | 2.0 | 800 | 2.0 |
| Comparative Example | A3-5 | A3 | 880 | 9 | 4.5 | 2.0 | 800 | 2.0 |
| Example | A4-1 | A4 | 800 | 24 | 4.5 | 2.0 | 800 | 2.0 |
| Example | A5-1 | A5 | 800 | 24 | 4.5 | 2.0 | 800 | 2.0 |
| Comparative Example | B1-1 | B1 | 800 | 24 | 4.5 | 2.0 | 800 | 2.0 |
| Comparative Example | B1-2 | B1 | 780 | 24 | 4.5 | 2.0 | 800 | 2.0 |
| Comparative Example | B2-1 | B2 | 800 | 24 | 4.5 | 2.0 | 800 | 2.0 |

| Class | Example No. | Second cold rolling Final thickness (mm) | Second intermediate annealing Temperature (° C.) | Third cold rolling Initial thickness (mm) | Third cold rolling Final thickness (mm) | Finish annealing Maximum finally acheiving material temperature (° C.) | Finish annealing Retention time at 1020° C. or more (s) |
|---|---|---|---|---|---|---|---|
| Example | A1-1 | 0.7 | 800 | 0.7 | 0.2 | 1060 | 4 |
| Example | A1-2 | 1.0 | — | — | — | 1060 | 12 |
| Example | A1-3 | 0.6 | — | — | — | 1080 | 8 |
| Comparative Example | A1-4 | 0.7 | 800 | 0.7 | 0.2 | 1000 | 0 (*1) |
| Comparative Example | A1-5 | 0.7 | 800 | 0.7 | 0.2 | 1060 | 5 |
| Example | A2-1 | 0.7 | 800 | 0.7 | 0.2 | 1040 | 5 |
| Example | A2-2 | 1.0 | — | — | — | 1060 | 13 |
| Example | A2-3 | 0.6 | — | — | — | 1080 | 9 |
| Comparative Example | A2-4 | 0.7 | 800 | 0.7 | 0.2 | 1040 | 2 |
| Comparative Example | A2-5 | 0.7 | 800 | 0.7 | 0.2 | 1060 | 5 |

TABLE 2-continued

| | | | | | | | |
|---|---|---|---|---|---|---|---|
| Example | A3-1 | 0.7 | 800 | 0.7 | 0.2 | 1060 | 4 |
| Example | A3-2 | 1.0 | — | — | — | 1020 | 11 |
| Example | A3-3 | 0.6 | — | — | — | 1080 | 12 |
| Comparative Example | A3-4 | 0.7 | 800 | 0.7 | 0.2 | 1040 | 2 |
| Comparative Example | A3-5 | 0.7 | 800 | 0.7 | 0.2 | 1060 | 6 |
| Example | A4-1 | 0.7 | 800 | 0.7 | 0.2 | 1060 | 5 |
| Example | A5-1 | 0.7 | 800 | 0.7 | 0.2 | 1060 | 4 |
| Comparative Example | B1-1 | 0.7 | 800 | 0.7 | 0.2 | 1060 | 5 |
| Comparative Example | B1-2 | 1.0 | — | — | — | 1060 | 14 |
| Comparative Example | B2-1 | 0.7 | 800 | 0.7 | 0.2 | 1060 | 5 |

Underline: outside the scope of invention,
(*1): 1000° C. × soaking time of 60 seconds

TABLE 3

| Class | Example No. | Number density of carbonitride having circle equivalent diameter of 1.0 μm or more (per 0.01 $mm^2$) | Tensile characteristics in rolling direction: 0.2% yield strength ($N/mm^2$) | Tensile characteristics in rolling direction: Tensile strength ($N/mm^2$) | Tensile characteristics in rolling direction: Elongation (%) | Hardness (HV) | Delayed fracture resistance Fracture time (h) | Bendability Critical bending radius (mm) | Total evaluation |
|---|---|---|---|---|---|---|---|---|---|
| Example | A1-1 | 4 | 1285 | 1501 | 8.1 | 484 | 120 | 0.2 | A |
| Example | A1-2 | 7 | 1293 | 1497 | 7.1 | 483 | 144 | 0.2 | A |
| Example | A1-3 | 10 | 1340 | 1565 | 7.2 | 500 | 120 | 0.6 | A |
| Comparative Example | A1-4 | 44 | 1165 | 1366 | 8.4 | 440 | 24 | 0.8 | B |
| Comparative Example | A1-5 | 24 | 1273 | 1501 | 7.1 | 485 | 6 | 0.8 | B |
| Example | A2-1 | 7 | 1191 | 1449 | 7.4 | 470 | 120 | 0.2 | A |
| Example | A2-2 | 4 | 1311 | 1531 | 7.3 | 495 | 168 | 0.4 | A |
| Example | A2-3 | 6 | 1359 | 1584 | 6.4 | 509 | 72 | 0.6 | A |
| Comparative Example | A2-4 | 50 | 1193 | 1365 | 8.1 | 443 | 24 | 0.6 | B |
| Comparative Example | A2-5 | 34 | 1297 | 1504 | 6.9 | 491 | 4 | 0.8 | B |
| Example | A3-1 | 8 | 1317 | 1534 | 7.3 | 490 | 96 | 0.2 | A |
| Example | A3-2 | 7 | 1173 | 1379 | 7.8 | 446 | 216 | 0.2 | A |
| Example | A3-3 | 14 | 1363 | 1593 | 6.9 | 514 | 192 | 0.4 | A |
| Comparative Example | A3-4 | 38 | 1180 | 1381 | 8.1 | 448 | 24 | 0.8 | B |
| Comparative Example | A3-5 | 40 | 1309 | 1520 | 7.4 | 490 | 5 | 1.0 | B |
| Example | A4-1 | 9 | 1294 | 1500 | 7.4 | 487 | 168 | 0.4 | A |
| Example | A5-1 | 11 | 1381 | 1631 | 7.0 | 519 | 144 | 0.6 | A |
| Comparative Example | B1-1 | 53 | 1403 | 1640 | 6.3 | 533 | 4 | 0.8 | B |
| Comparative Example | B1-2 | 46 | 1418 | 1613 | 6.9 | 524 | 3 | 1.0 | B |
| Comparative Example | B2-1 | 12 | 978 | 1343 | 7.5 | 487 | 120 | — | B |

Underline: outside the scope of invention

The examples of the invention were controlled to the martensite structure having a small amount of the undissolved carbonitride having a large size, and thus exhibited excellent strength-delayed fracture resistance balance irrespective of the martensitic stainless steel. The specimens of the invention had a critical bending radius of from 0.2 to 0.6 mm, and thus were confirmed to have better bendability than the comparative examples having a critical bending radius of from 0.8 to 1.0 mm.

On the other hand, No. A1-4 as the comparative example was subjected to finish annealing at 1,000° C. for a soaking time of 60 seconds, and thus had a large amount of the undissolved carbonitride having a large size remaining due to the low finish annealing temperature, irrespective of the heating and retaining time of 60 seconds. As a result, the delayed fracture resistance thereof was not sufficiently improved. Nos. A1-5, A2-5, and A3-5 had the coarse carbonitride formed through the decomposition of the martensite phase due to the too high hot rolled sheet annealing temperature, and thus had a large amount of the undissolved carbonitride having a large size remaining after the finish annealing. As a result, the delayed fracture resistance thereof was poor. Nos. A2-4 and A3-4 had a large existing amount of the undissolved carbonitride having a large size due to the short retention time at 1,020° C. or more in the finish annealing, resulting in poor delayed fracture resistance. Nos. B1-1 and B1-2 had a large amount of the carbonitride formed due to the high C content of the steel, and associated therewith, a large amount of the undissolved carbonitride having a large size remained after the finish annealing, resulting in poor delayed fracture resistance. No. B2-1 had the dual phase structure including a soft ferrite phase due to the chemical composition having a low M value, and thus had a low 0.2% yield strength.

The invention claimed is:

1. A martensitic stainless steel sheet having: a chemical composition containing, in terms of percentage by mass, from 0.10 to 0.15% of C, from 0.05 to 0.80% of Si, from 0.05 to 2.00% of Mn, 0.040% or less of P, 0.003% or less of S, from 0.05 to 0.50% of Ni, from 11.0 to 15.0% of Cr, from 0.02 to 0.50% of Cu, from 0.005 to 0.06% of N, from 0.001 to 0.20% of Al, from 0 to 1.00% of Mo, from 0 to 0.50% of V, from 0 to 0.01% of B, the balance of Fe and unavoidable impurities, and having an M value defined by the following expression (1) of 100 or more; a metal structure including a martensite phase as a matrix, and having a number density of a carbonitride having a circle equivalent diameter of 1.0 μm or more of 15.0 or less per 0.01 $mm^2$ on a cross section in parallel to a rolling direction and a thickness direction (L cross section); and a 0.2% yield strength in a rolling direction of 1,100 $N/mm^2$ or more:

$$M \text{ value} = 420C - 11.5Si + 7Mn + 23Ni - 11.5Cr - 12Mo - 10V + 9Cu - 52Al + 470N + 189 \quad (1)$$

wherein in the expression (1), the element symbol is substituted by the content of the element in terms of percentage by mass, and is substituted by 0 for an element that is not contained.

2. A method for producing the martensitic stainless steel sheet according to claim 1, comprising a steel sheet production process including hot rolling, hot rolled sheet annealing, cold rolling, and finish annealing, in this order, the hot rolled sheet annealing step including retaining at a temperature range of from 750 to 840° C. for 6 hours or more to decompose a martensite phase to a ferrite phase and a carbonitride, the finish annealing step including retaining to a temperature range of from 1,020 to 1,100° C. for 4 seconds or more.

3. A method for producing the martensitic stainless steel sheet according to claim 1, comprising a steel sheet production process including hot rolling, hot rolled sheet annealing, plural steps of cold rolling with intermediate annealing intervening therebetween, and finish annealing, in this order, the hot rolled sheet annealing step including retaining at a temperature range of from 750 to 840° C. for 6 hours or more to decompose a martensite phase to a ferrite phase and a carbonitride, the finish annealing step including retaining to a temperature range of from 1,020 to 1,100° C. for 4 seconds or more.

4. A spring member comprising the martensitic stainless steel sheet according to claim 1.

* * * * *